US011459764B2

(12) United States Patent
Lentowich et al.

(10) Patent No.: US 11,459,764 B2
(45) Date of Patent: Oct. 4, 2022

(54) VENTILATION DEVICE FOR A FABRIC BUILDING

(71) Applicant: G&B Portable Fabric Buildings Inc., Cooks Creek (CA)

(72) Inventors: Alexander Lentowich, Cooks Creek (CA); Ryan Hunter, Cooks Creek (CA)

(73) Assignee: GNB Global Inc., Cooks Creek (CA)

( * ) Notice: Subject to any disclaimer, the term of this patent is extended or adjusted under 35 U.S.C. 154(b) by 320 days.

(21) Appl. No.: 16/672,982

(22) Filed: Nov. 4, 2019

(65) Prior Publication Data

US 2021/0131109 A1 May 6, 2021

(51) Int. Cl.
*E04D 13/17* (2006.01)
*E04D 13/147* (2006.01)
*F24F 7/02* (2006.01)

(52) U.S. Cl.
CPC ..... *E04D 13/1476* (2013.01); *F24F 7/02* (2013.01)

(58) Field of Classification Search
CPC combination set(s) only.
See application file for complete search history.

(56) References Cited

U.S. PATENT DOCUMENTS 3,345,932 A * 10/1967 Sauer ..... F24F 7/02 454/275
3,872,634 A 3/1975 Seaman
4,886,084 A * 12/1989 Lawrence ..... E04H 15/18 135/124
5,647,178 A * 7/1997 Cline ..... E04D 13/1476 285/43
6,102,794 A * 8/2000 Cline ..... F24F 7/02 454/368
7,938,132 B2 5/2011 Li

* cited by examiner

*Primary Examiner* — Ko-Wei Lin
(74) *Attorney, Agent, or Firm* — Ryan W. Dupuis; Kyle R. Satterthwaite; Ade & Company Inc.

(57) ABSTRACT

A ventilation device is supported in at a ventilation opening in a fabric panel of a building in which the fabric panel is supported under tension across a frame. The device includes a lower frame and an intermediate frame with respective flanges that receive a perimeter edge of the fabric panel about the ventilation opening therebetween. A cover is joined to the frames so as to prevent precipitation entering the frame opening while providing exterior ventilation from the ventilation opening of the building through one or more exterior openings in the cover.

15 Claims, 6 Drawing Sheets

VENTILATION DEVICE FOR A FABRIC BUILDING

FIELD OF THE INVENTION

The present invention relates to a ventilation device allowing ventilation of a fabric building through a ventilation opening in a fabric panel of the building in which the ventilation device includes at least one exterior opening therein which is oriented to prevent entry of precipitation into the building through the ventilation opening.

BACKGROUND

Fabric buildings are commonly used in instances where it is desirable to quickly erect a building enclosure at low cost. As described in U.S. Pat. No. 3,872,634 by Seaman, a common structure of a fabric building involves a rigid building frame of posts and trusses which define the general shape of the building, and fabric panels which are mounted under tension to span over the building frame to define an outer boundary of the resulting building enclosure. Ventilation through the enclosure is provided by a vent hood which is rigidly connected to the building frame at an edge of the fabric panels being tensioned across the frame. The location of the vent hood is thus limited to an apex of the building frame so as not to interfere with tensioning of the fabric.

In another example of a fabric building, U.S. Pat. No. 7,938,132 by Li provides a building frame supporting a fabric canopy extending over the building frame. Vents are provided, however, the absence of any substantial frame limits the ability to tension the fabric panels such that the fabric panels are limited in the loads that they can support.

SUMMARY OF THE INVENTION

According to one aspect of the invention there is provided a ventilation device for a building including a fabric panel supported under tension across a building frame of the building and a ventilation opening in the fabric panel, the ventilation device comprising:

a lower frame formed of rigid material having a perimeter flange surrounding a frame opening in the lower frame, the perimeter flange being arranged to be secured to the fabric panel about a perimeter of the ventilation opening in the fabric panel such that the lower frame is supported by the fabric panel and such that the frame opening in the lower frame is aligned with the ventilation opening in the fabric panel;

a cover joined to the lower frame so as to span over the frame opening, the cover defining at least one exterior opening in communication with the frame opening so as to prevent precipitation entering the frame opening while providing exterior ventilation from the ventilation opening of the building to said at least one exterior opening.

According to a second aspect of the present invention there is provided a fabric building comprising:

a building frame;

a fabric panel supported under tension across a portion of the building frame of the building so as to define an exterior surface of the building, the fabric panel including a ventilation opening therein;

a ventilation device comprising:

a lower frame formed of rigid material having a perimeter flange surrounding a frame opening in the lower frame, the perimeter flange being secured to the fabric panel about a perimeter of the ventilation opening in the fabric panel such that the lower frame is supported by the fabric panel and such that the frame opening in the lower frame is aligned with the ventilation opening in the fabric panel;

a cover joined to the lower frame so as to span over the frame opening, the cover defining at least one exterior opening in communication with the frame opening so as to prevent precipitation entering the frame opening while providing exterior ventilation from the ventilation opening of the building to said at least one exterior opening.

Use of a rigid frame secured to the fabric panel about a ventilation opening allows the fabric panel to remain able to be tensioned in any direction as the rigid frame is capable of transferring the tension across the ventilation opening. Arranging the frame to be fully supported by the fabric panel further allows a ventilation opening to be provided at any desirable location within a fabric building independent of the location of any rigid frame members of the building.

Preferably the perimeter flange is arranged to be mechanically coupled to the fabric panel about a full perimeter of the ventilation opening in the fabric panel.

In the illustrated embodiments, the device further comprises an intermediate frame including a mounting flange surrounding a frame opening in the intermediate frame, in which the intermediate frame is arranged to be coupled to the lower frame such that the frame opening of the intermediate frame is aligned with the frame opening of the lower frame and such that the mounting flange of the intermediate frame is supported in close proximity to the perimeter flange therebelow, whereby the perimeter of the fabric panel about the ventilation opening is arranged to be secured between the perimeter flange of the lower frame below the fabric panel and the mounting flange of the intermediate frame above the fabric panel.

The lower frame may include an inner collar extending upwardly from an inner edge of the perimeter flange about the frame opening.

When the intermediate frame includes a mounting flange surrounding a frame opening in the intermediate frame and an outer collar extending upwardly from an inner edge of the mounting flange, the outer collar is preferably arranged to surround the inner collar of the lower frame with the perimeter of the fabric panel about the ventilation opening being secured between the perimeter flange of the lower frame below the fabric panel and the mounting flange of the intermediate frame above the fabric panel.

The intermediate frame may be secured to the lower frame using threaded fasteners extending through cooperating apertures in the intermediate frame and the lower frame respectively. Preferably the threaded fasteners are oriented to extend in an axial direction of the lower frame at circumferentially spaced apart locations between the inner collar and the outer collar. When the intermediate frame further comprises an upper flange protruding inwardly from the outer collar at a location spaced above the mounting flange of the intermediate frame, the threaded fasteners may be coupled between the upper flange of the intermediate frame and the perimeter flange of the lower frame.

The exterior opening(s) are preferably offset in a radial direction of the lower frame relative to the frame opening of the lower frame.

When the lower frame includes an inner collar extending upwardly from an inner edge of the perimeter flange about the frame opening, the cover preferably protrudes radially outward beyond the inner collar about a full perimeter of the inner collar.

The cover may include a central cover portion which is devoid of openings and which fully spans over the frame opening of the lower frame.

In one embodiment, the one or more exterior openings face downwardly towards the lower frame; however, in further embodiments, the one or more exterior openings lie in an upright plane.

The cover may be supported for rotation relative to the lower frame about an upright axis of the frame opening.

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Figure 1:
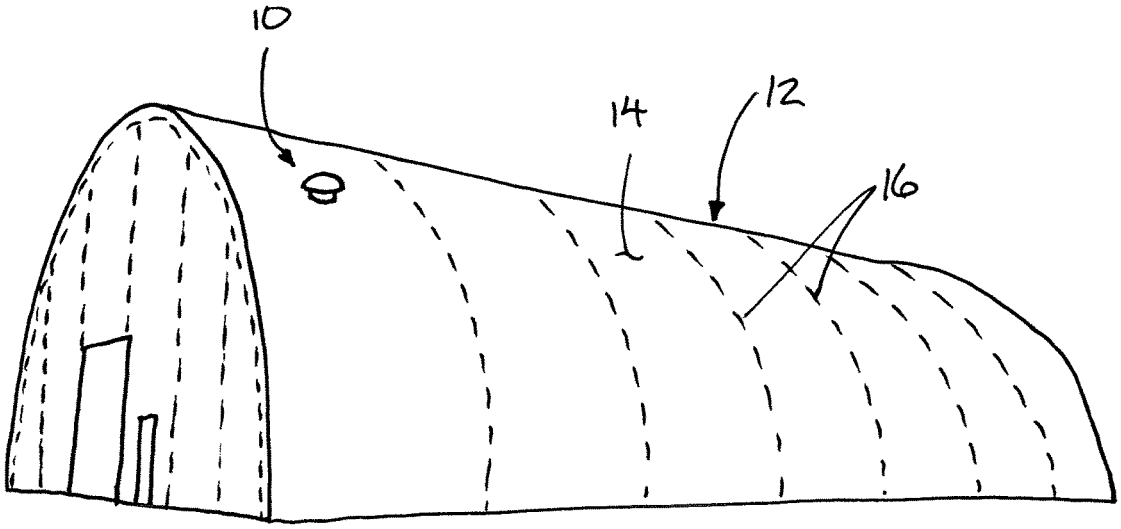
FIG. 1 is a perspective view of a fabric building locating the ventilation device according to the present invention therein.
Figure 2:
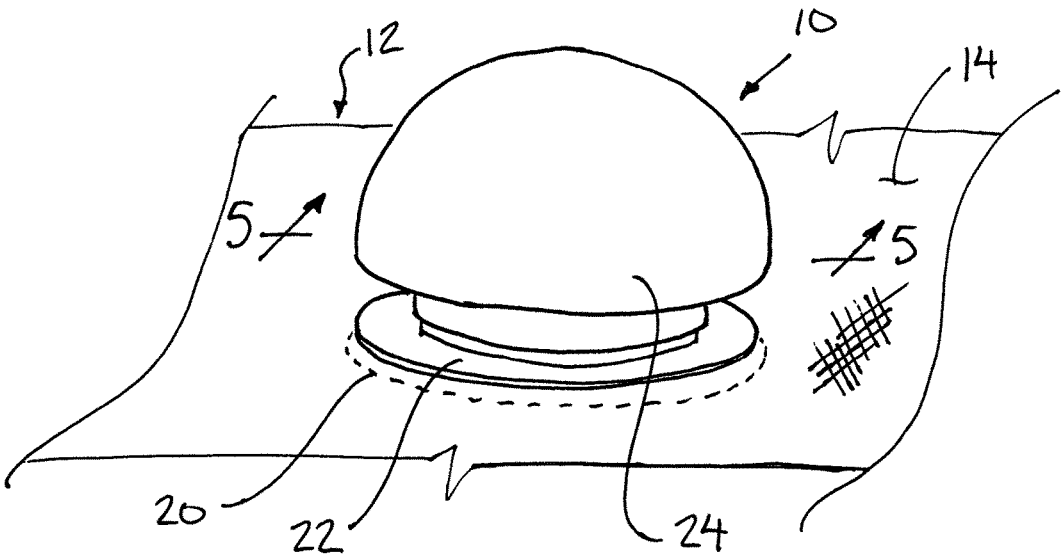
FIG. 2 is a perspective view according to a first embodiment of the ventilation device.
Figure 4:
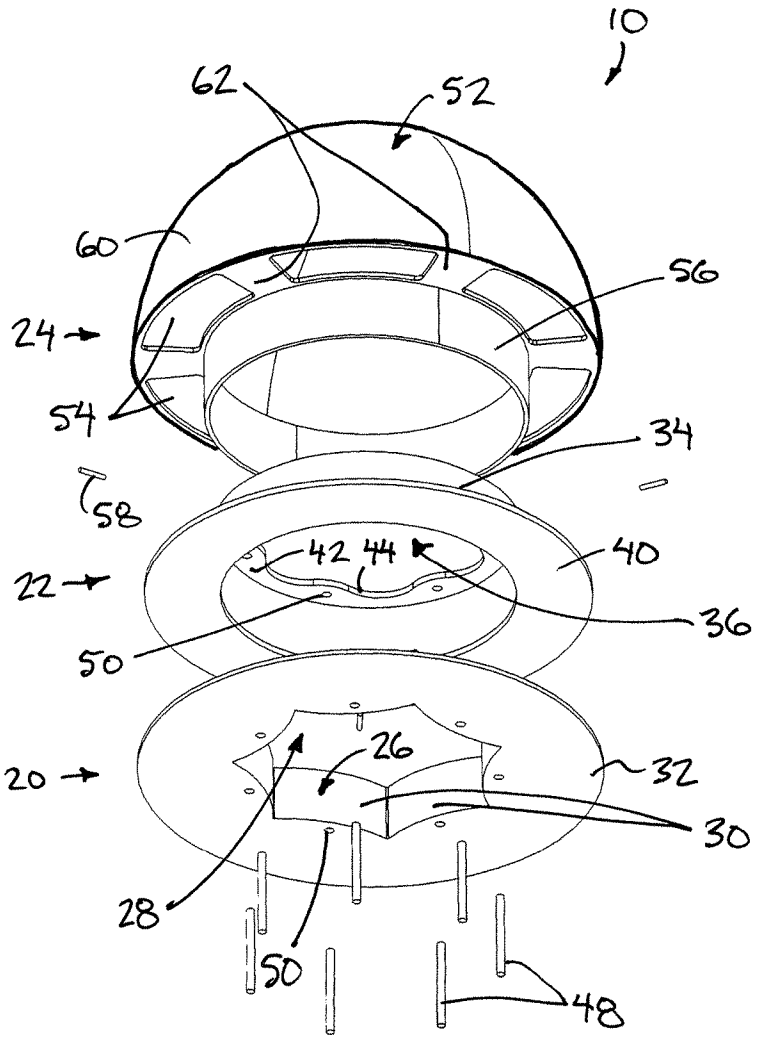
FIG. 4 is an exploded bottom perspective view of the ventilation device according to the first embodiment of FIG. 2.
Figure 3:
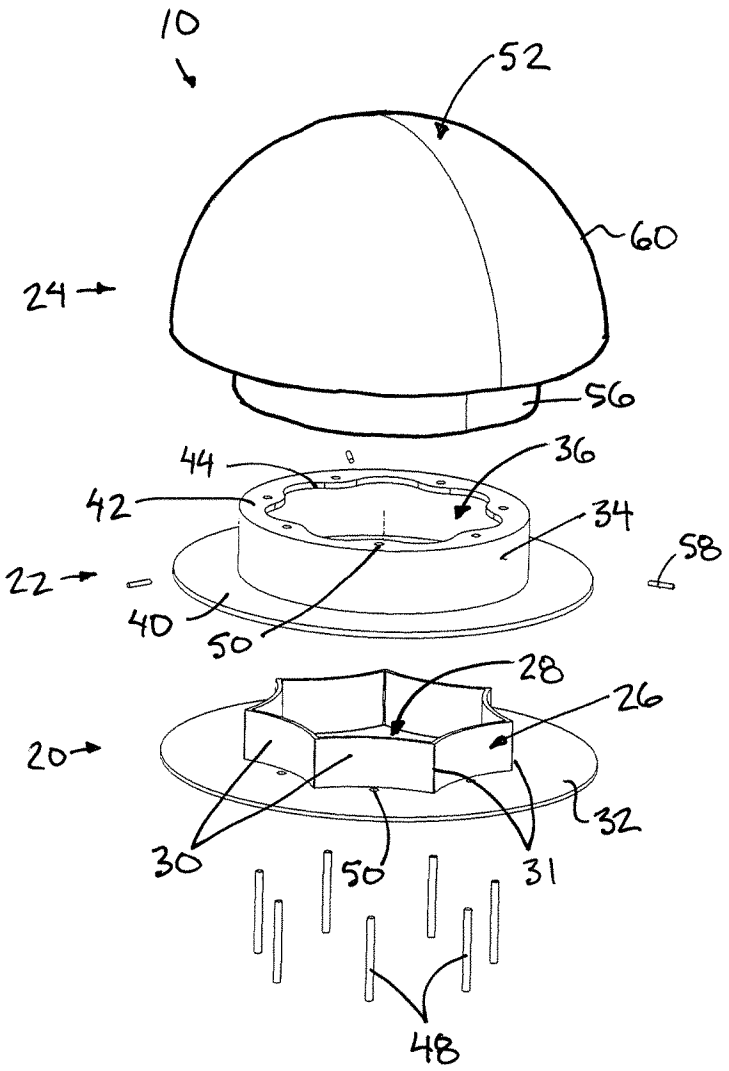
FIG. 3 is an exploded top perspective view of the ventilation device according to the first embodiment of FIG. 2.

Referring to the accompanying figures there is illustrated a ventilation device generally indicated by reference numeral 10. The device 10 is particularly suited for use with a fabric building 12 in which a portion or a majority of the exterior surfaces of the building are formed of fabric material defining a fabric shell 14 supported under tension over a building frame 16. In a typical fabric building, the building frame 16 generally comprises a plurality of poles, trusses, and/or rigid frame members of various types and configurations which are mounted together to support the fabric shell 14 thereon to form walls and/or a roof of the building. The fabric material typically comprises a woven plastic material which may be coated so as to form a complete barrier which is waterproof and weatherproof. The fabric material remains flexible through a large range of ambient temperatures. The fabric material is typically supported under tension in two transverse directions such that the fabric shell is capable of supporting loads thereon from precipitation such as snow for example. The building frame is typically shaped so that the fabric shell 14 can be supported thereon in a manner which causes most of the precipitation to be shed off of the fabric shell so that only small loads are typically required to be carried by the fabric shell.

The ventilation device 10 is mounted in one of the panels of the fabric shell defining either a portion of a wall or a portion of a roof of the building. The ventilation device 10 is mounted at the location of a ventilation opening 18 in the form of a circular hole cut into the fabric panel.

Although various embodiments of the ventilation device are shown in the accompanying figures and described herein, the features in common with the various embodiments will first be described.

In general, the ventilation device comprises (i) a lower frame 20 having a portion which mounts below the fabric shell 14 corresponding to the inside of the building, (ii) an intermediate frame 22 having a portion which mounts above the fabric shell corresponding to the exterior of the building so as to enable a portion of the fabric to be clamped between the lower frame and the intermediate frame, and (iii) a cover 24 that extends over the intermediate frame to prevent entry of precipitation into the ventilation opening in the fabric shell while defining one or more exterior openings through which the ventilation opening can be vented to the exterior of the building.

The lower frame 20, the intermediate frame 22 and the cover 24 are all formed of rigid materials which are lightweight, for example plastic or thin sheet metal. The frames are configured for mounting onto the flexible fabric sheet material of a fabric building such that the device 10 can be entirely supported by the fabric material relative to the building frame.

The lower frame 20 generally includes an inner collar 26 which surrounds a lower frame opening 28 of the lower frame 20. The inner collar has an upright perimeter wall which is parallel to an upright axis of the lower frame opening and of the inner collar. The lower frame opening 28 is sized to be approximately equal to or slightly undersized relative to the size of the ventilation opening 18 in the fabric shell. The perimeter wall forming the inner collar is formed of a plurality of wall segments 30 connected end to end with one another in the circumferential direction such that each wall segments spans the full height but only a portion of the circumference of the inner collar. Each wall segment is convex at the interior between the opposing ends thereof while being concave at the exterior between the opposing ends thereof in the circumferential direction. In this manner, each wall segments 30 joins an adjacent wall segment at an outwardly protruding apex 31. The resulting shape of the inner collar in plan view is generally star shaped.

The lower frame further includes a perimeter flange 32 which extends radially outward from a bottom end of the inner collar 26. The flange 32 lies in a flat plane oriented perpendicularly to the upright axis of the lower frame opening and of the inner collar while being annular in shape to extend about the full circumference of the inner collar. The outer diameter of the perimeter flange is greater than the diameter of the ventilation opening such that the perimeter flange is arranged to overlap against an inner surface of the fabric material about a full perimeter of the ventilation opening.

The intermediate frame 22 includes an outer collar 34 which is generally cylindrical in shape, having a height which is greater than the height of the inner collar 26 of the lower frame. The outer collar 34 of the intermediate frame surrounds an intermediate frame opening 36 having a diameter approximately equal to the diameter of the vent opening in the fabric sheet. An inner diameter of the outer collar 34 is near but slightly greater than the diameter of a circle circumscribing the star shape of the inner collar 26. In this manner, the inner collar 26 can be inserted to extend upwardly through the interior of the outer collar 34 in a mounted position of the intermediate frame upon the lower frame. In the mounted position of the frames, a pocket 38 is defined between each wall segment 30 and a respective portion of the outer collar 34 in the circumferential direction thereof. When viewed from above, each pocket 38 has a geometric shape which approximates a lens comprising two arcs joined at respective end points thereof.

The intermediate frame 22 further includes a mounting flange 40 which protrudes radially outward from the bottom of the outer collar 34. The mounting flange lies in a flat plane oriented perpendicularly to an axis of the outer collar 34 and the corresponding frame opening 36, while being annular in shape to protrude from the outer collar about the full circumference thereof. The outer diameter of the mounting flange 40 is greater than the diameter of the vent opening in the fabric sheet and is near to the outer diameter of the perimeter flange 32 of the lower frame. In this manner, the intermediate frame can be mounted overtop of the lower frame at a vent opening in the fabric sheet such that the mounting flange 40 of the intermediate frame overlaps a significant portion of the outer surface of the fabric sheet about the full circumference of the vent opening. Furthermore, a portion of the fabric sheet about the perimeter of the vent opening is effectively clamped between the perimeter flange 32 of the lower frame below and the mounting flange 40 of the intermediate frame above.

The intermediate frame also includes an upper flange 42 which protrudes radially inwardly from the top end of the outer collar 34. The upper flange 42 lies in a flat plane oriented perpendicularly to an axis of the outer collar and the corresponding frame opening 36, while being generally annular in shape to protrude inwardly from the outer collar about the full circumference thereof. The inner edge 44 of the upper flange 42 is generally scalloped in shape so as to define a convex segment in alignment with each of the corresponding wall segments 30 of the inner collar of the lower frame. The inner edge 44 of the upper flange 42 of the intermediate frame thus closely follows the shape of the inner surface of the inner collar 26 of the lower frame 20. Each convex segment is thus aligned with and extends over the top side of a respective one of the pockets 38 defined between the inner and outer collars, without substantially obstructing the lower frame opening 28 defined within the inner collar 26 of the lower frame.

The lower frame 20 and the intermediate frame 22 are coupled together using a plurality of bolts 48 which are mounted to extend in the axial direction parallel to the axis of the inner and outer collars. Each bolt is associated with a respective pocket 38 within which it is received such that the bolt extends through a first fastener aperture 50 located within the upper flange 42 of the intermediate frame and a second fastener aperture 50 located in the perimeter flange 32 of the lower frame. The bolt 48 is provided with a head at one end of the bolt and a nut threaded onto the opposing end of the bolt for clamping the intermediate frame and the lower frame together with a portion of the fabric sheet about the perimeter of the vent opening in the fabric sheet being clamped between the perimeter flange of the lower frame and the mounting flange of the intermediate frame.

Mounting of the frames relative to the fabric sheet involves inserting the inner collar 26 of the lower frame upwardly through the vent opening in the fabric sheet until the perimeter flange of the lower frame abuts the inner surface of the fabric sheet. The intermediate frame 22 is then placed overtop of the protruding inner collar of the lower frame to receive the inner collar 26 of the lower frame within the outer collar 34 of the intermediate frame and to abut the mounting flange 40 of the intermediate frame against the outer surface of the fabric sheet. The bolts are then inserted through the cooperating fastener apertures 50 in the lower and intermediate frames. To improve the sealing interface between the frames and the fabric sheet, an additional gasket may be clamped between the flanges of the lower frame and the intermediate frame together with the perimeter edge of the fabric sheet. Alternatively, a suitable adhesive or sealant type material can also be clamped together with the fabric sheet between the lower and intermediate frames.

In each instance, the cover 24 mounts overtop of the intermediate frame at the exterior of the building so that the cover spans over the intermediate frame opening 36 of the intermediate frame in a manner that prevents entry of precipitation into the frame opening, and into the corresponding lower frame opening of the lower frame and ventilation opening in the fabric sheet aligned therewith.

The cover includes a central cover portion 52 at the top side thereof which is aligned with the frame openings by being provided centrally at the top side of the cover. The central cover portion is devoid of any openings.

The cover 24 further includes one or more exterior openings 54 formed therein in which each opening lies within a respective plane which is oriented either vertically or facing partly or fully downward for limiting the entry of precipitation through the exterior openings of the cover.

Figure 5:
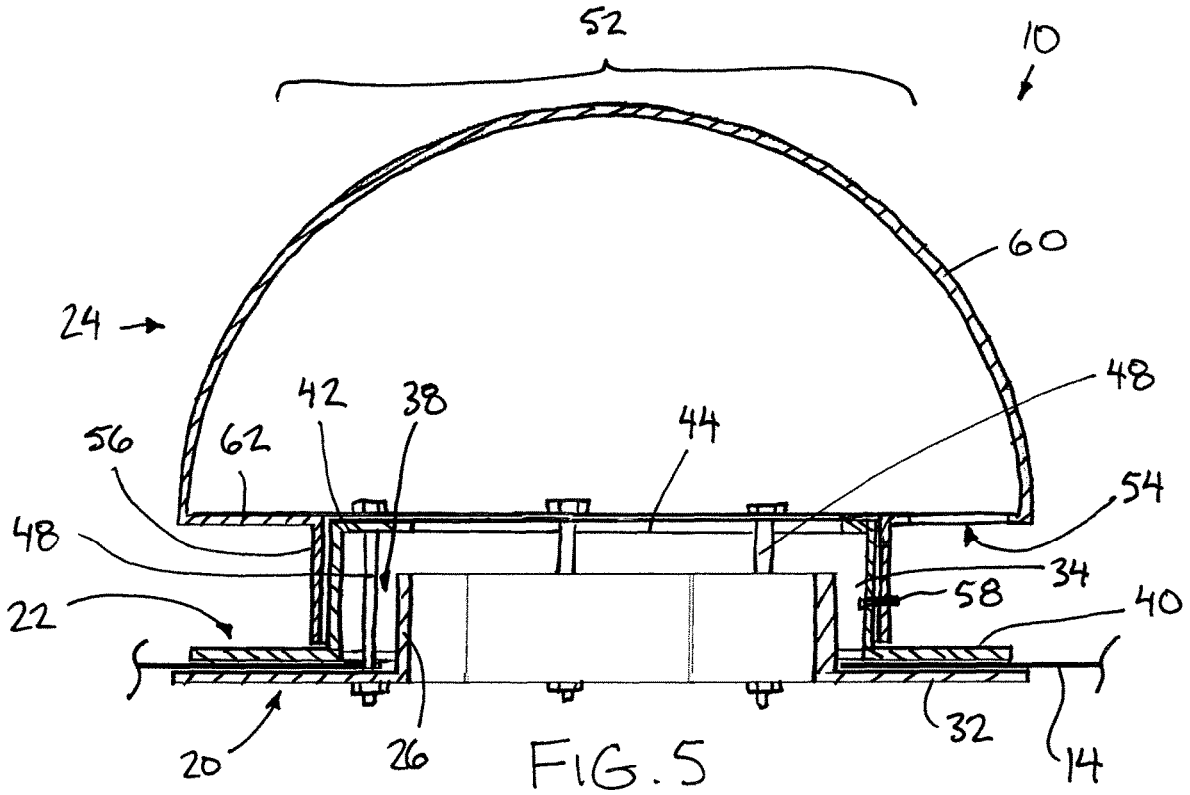
FIG. 5 is a sectional view of the ventilation device along the line 5-5 in FIG. 2.
Figure 6:
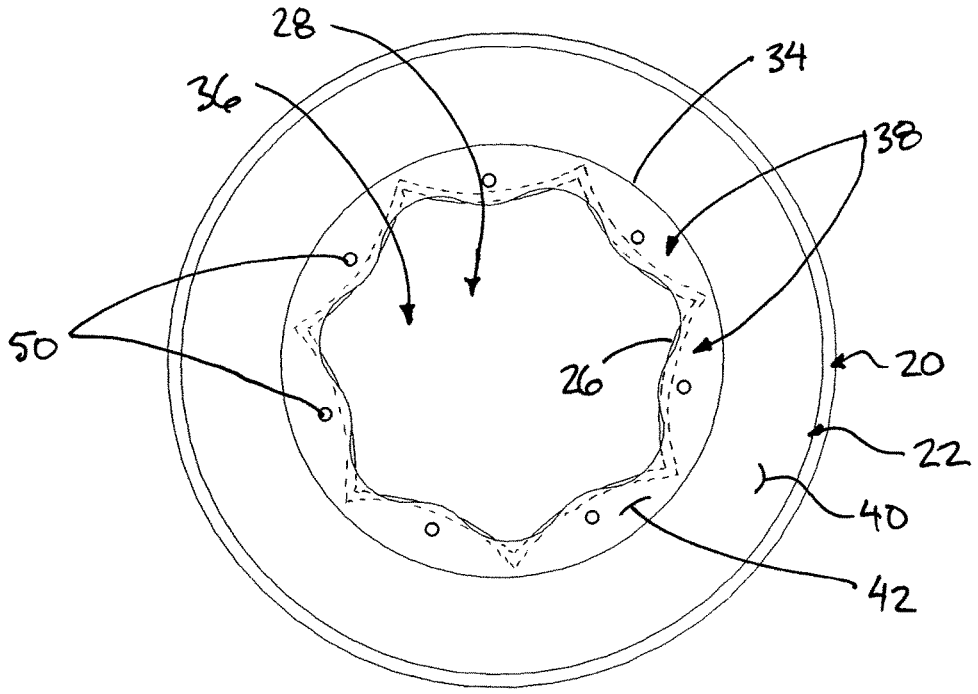
FIG. 6 is a top plan view of the intermediate and lower frames of the ventilation device according to the first embodiment of FIG. 2 with the cover removed.
Figure 7:
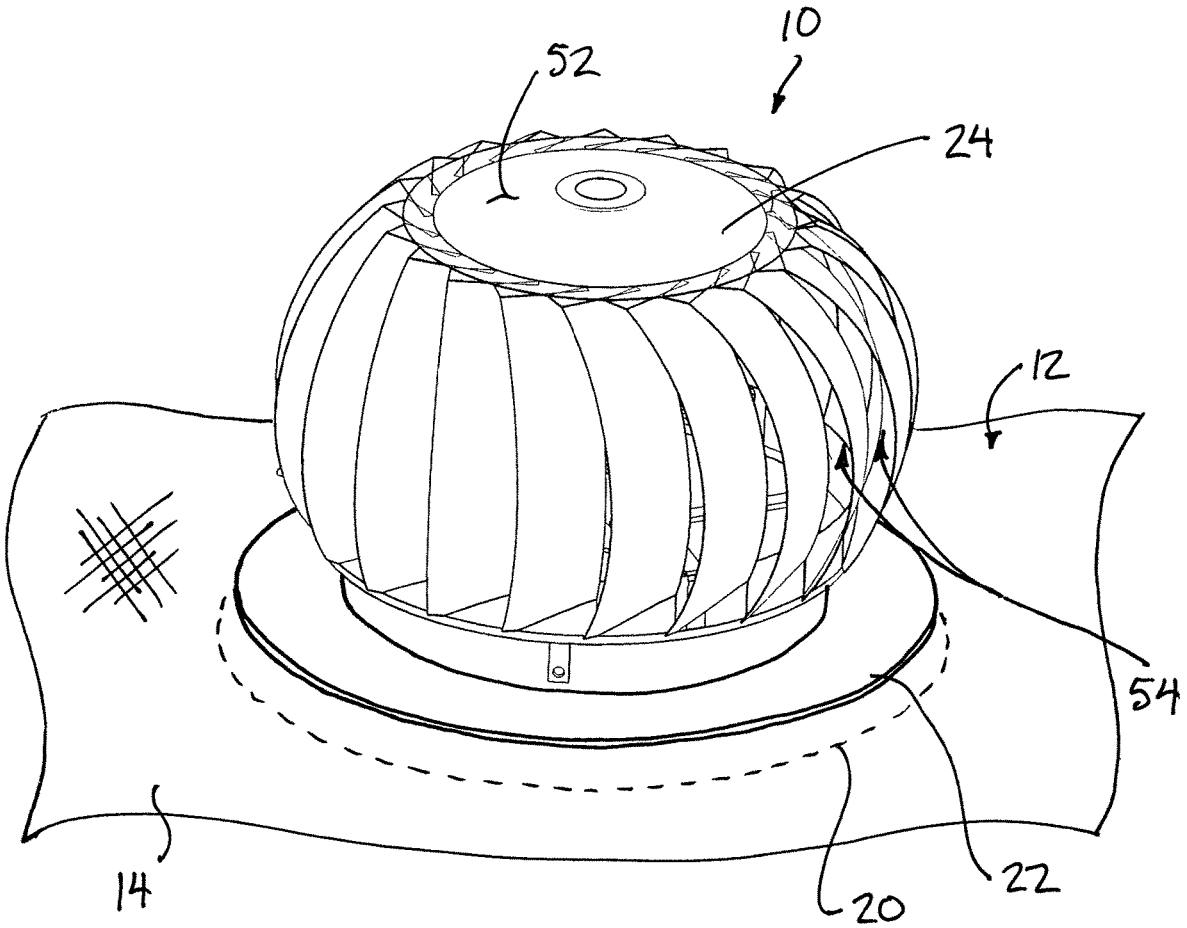
FIG. 7 is a perspective view according to a second embodiment of the ventilation device.
Figure 9:
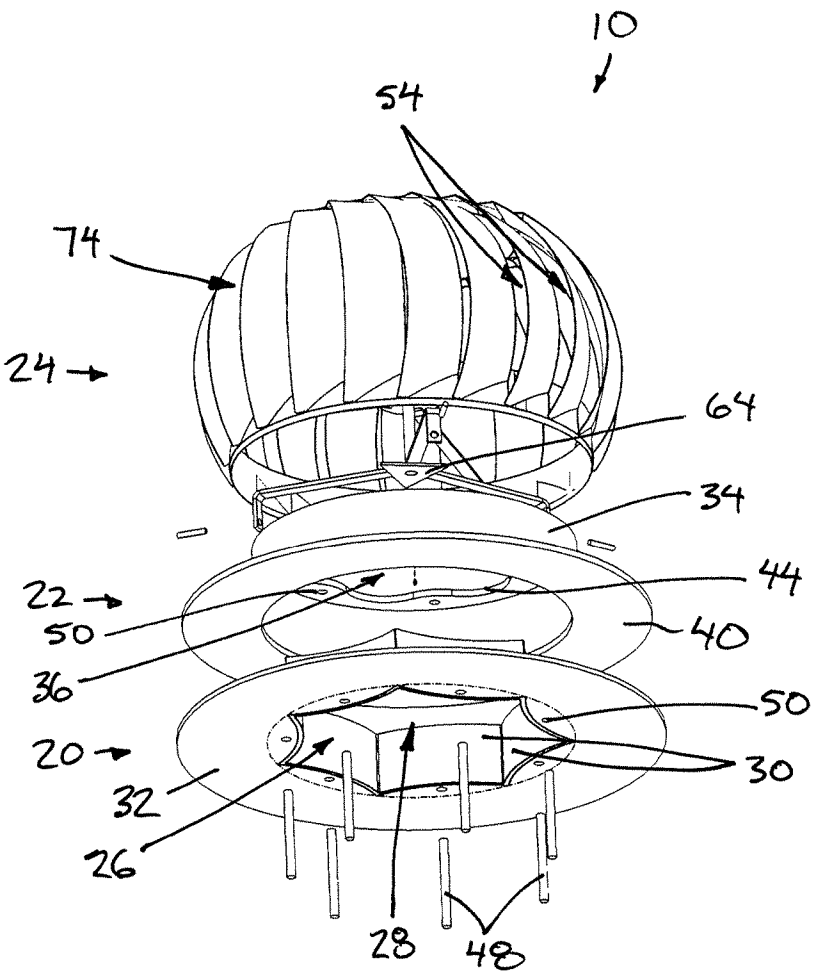
FIG. 9 is an exploded bottom perspective view of the ventilation device according to the second embodiment of FIG. 7.
Figure 8:
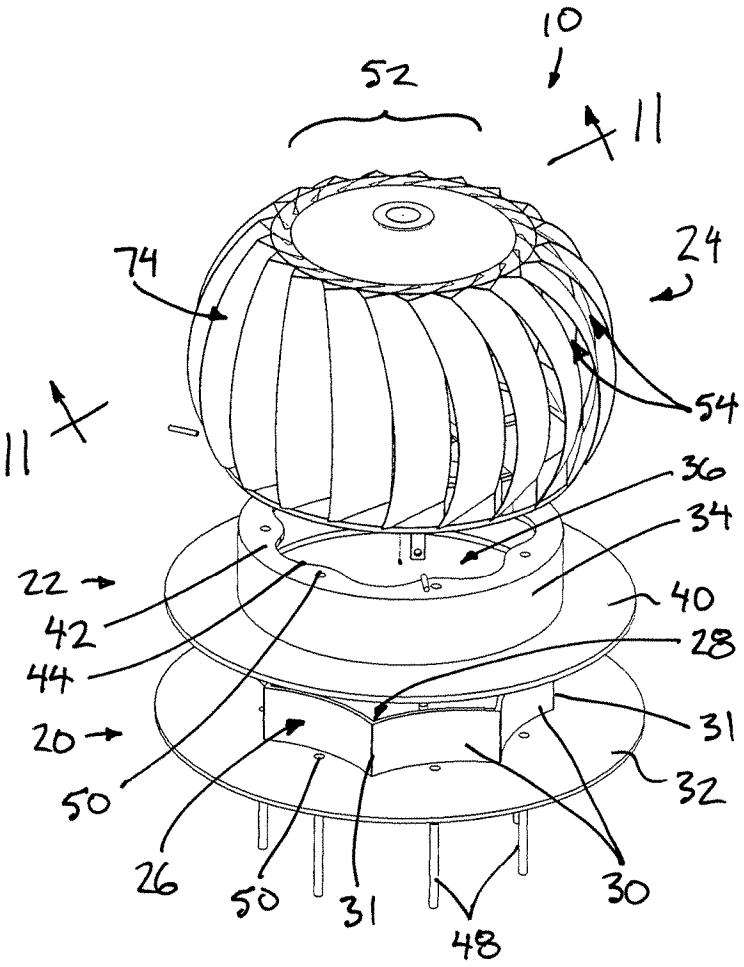
FIG. 8 is an exploded top perspective view of the ventilation device according to the second embodiment of FIG. 7.
Figure 10:
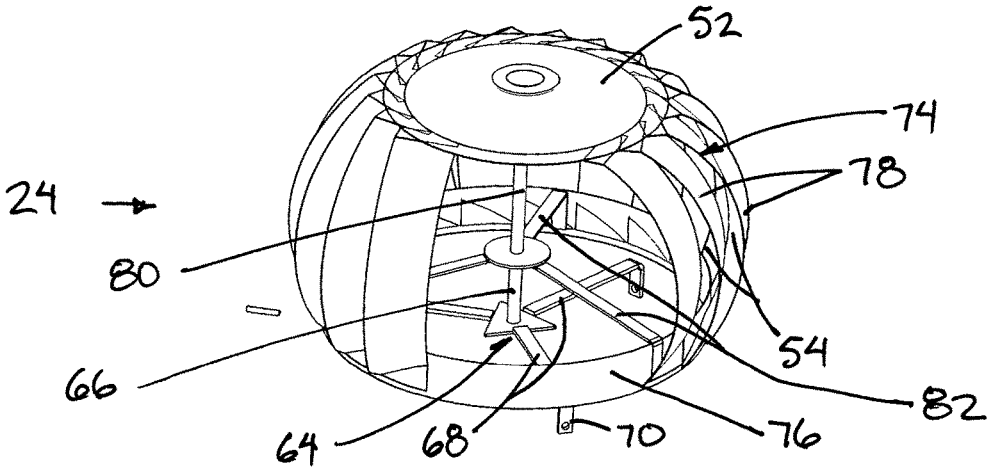
FIG. 10 is a perspective view of the cover of the ventilation device according to the second embodiment of FIG. 7 with some of the vanes shown removed for illustrative purposes.
Figure 11:
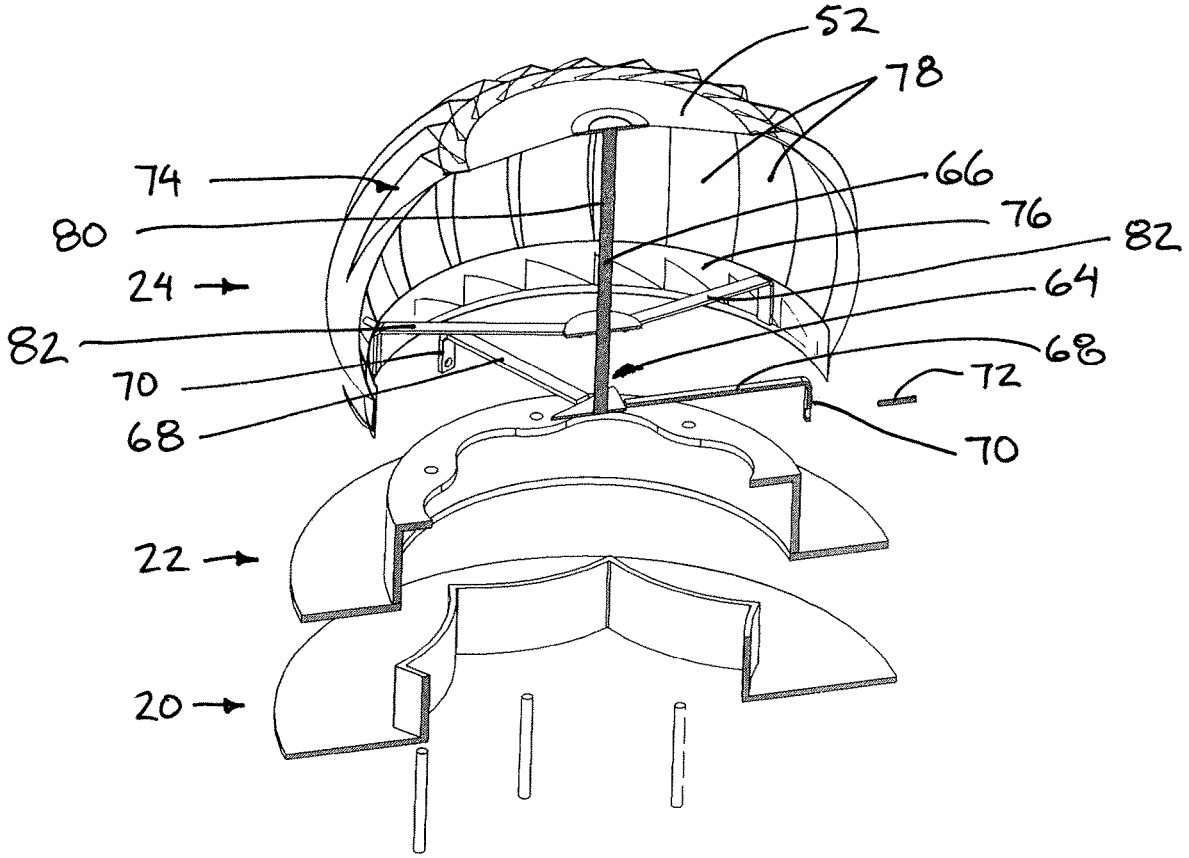
FIG. 11 is a sectional view along the line 11-11 in FIG. 8.

Turning now to the embodiment of FIGS. 2 through 6, according to a first embodiment of the device 10, the cover 24 is mounted in fixed relation to the intermediate frame. In this instance the cover includes a lower collar 56 having an interior diameter which is greater than the outer diameter of the outer collar of the intermediate frame to allow the lower collar 56 to be inserted overtop of the collar of the intermediate frame. A set of radial fasteners 58 are penetrated radially through the lower collar 56 and the outer collar of the intermediate frame for fixing the lower collar relative to the intermediate frame. The cover in this instance further includes an upper member 60 which is generally dome shaped and fully defines the central cover portion 52 of the cover. The outer diameter of the upper member 60 is greater than the lower collar 56 such that the upper member protrudes radially outward beyond the lower collar 56 about the full circumference thereof. As shown in FIG. 5, the lower portion (lower collar 56) of the cover overlaps an exterior surface portion of the outer collar 34 of the intermediate frame 22 at a location below the upper portion (upper member 60) of the cover by spanning a full height of the outer collar 34 of the intermediate frame so that the cover is arranged to be secured to the outer collar of the intermediate frame by a set of radial fasteners penetrated through the lower portion of the cover and the outer collar of the intermediate frame.

A plurality of spokes 62 are fixedly mounted to extend radially from the lower collar 56 to the bottom edge of the upper member 62 span across the radial gap between the collar 56 and the upper member. In this manner the upper member is fixed relative to the lower collar 56. The exterior openings 54 in this instance are each defined between an adjacent pair of the spokes 62 within the portion of the upper member 60 that protrudes outward beyond the boundary of the lower collar 56. Each exterior opening in this instance lies in a horizontal plane facing downwardly towards the lower collar therebelow. The exterior openings 54 are spaced apart from one another in the circumferential direction evenly about the full circumference.

Turning now to the second embodiment of FIGS. 7 through 11, the cover 24 in this instance is supported to be rotatable relative to the intermediate frame 22 and the lower frame 20 therebelow. The cover in this instance includes an inner frame 64 comprised of a vertical shaft 66 fixedly coupled to three spokes 68 which radiate outwardly from the bottom end of the shaft at evenly spaced apart positions in the circumferential direction. Each spoke includes a depending leg 70 extending downward from the outer end thereof which is fixed to the outer collar 34 of the intermediate frame using radially oriented fasteners 72 penetrated therethrough.

An upper member 74 is rotatably supported on the inner frame 64. The upper frame is generally spherical in shape and includes a bottom collar 76 at the bottom end of the upper member which defines a bottom opening therethrough. The bottom collar has an inner diameter which is slightly greater than the outer diameter of the outer collar and of a circle circumscribing the spokes of the inner frame 64. The upper member further includes the central cover portion 52 at the top end thereof.

A plurality of vanes 78 are each connected between the central cover portion at the top and the bottom collar 76 at the bottom of the upper member so as to define the overall spherical shape of the upper member 74 while fixedly connecting the central cover portion 52 to the bottom collar 76.

The upper member is coupled to the inner frame 64 by a sleeve 80 rotatably supported over the vertical shaft 66. A set of spokes 82 are fixed radially between the sleeve 80 and the bottom collar 76 in proximity to the bottom end of the sleeve, while the top end of the sleeve is fixed below the central cover portion 52 at the top of the upper member 74.

The exterior openings 54 of the cover are each defined between an adjacent pair of the vanes 78 so that the exterior openings are evenly spaced apart in the circumferential direction about the full perimeter of the upper member 74. The vanes are angled relative to radial and tangential axes in a common direction of rotation such that each exterior opening is defined between the trailing edge of one vane and the leading edge of the next vane within a respective plane which is substantially vertical and approximately radial in orientation. In this manner, wind from any direction is collected by vanes at one side of the upper member while passing over the vanes of the opposing side to induce rotation of the upper member.

A fan for generating an axial flow of air through the frame openings in the lower and intermediate frames can be optionally coupled to the sleeve 84 rotation together with the upper member.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A ventilation device for a building including a fabric panel supported under tension across a building frame of the building and a ventilation opening in the fabric panel, the ventilation device comprising:

a lower frame formed of rigid material having a perimeter flange surrounding a frame opening in the lower frame and an inner collar extending upwardly from an inner edge of the perimeter flange about the frame opening;

an intermediate frame including a mounting flange surrounding a frame opening in the intermediate frame and an outer collar extending upwardly from an inner edge of the mounting flange, the intermediate frame being arranged to be coupled to the lower frame such that: (i) the frame opening of the intermediate frame is aligned with the frame opening of the lower frame, (ii) the outer collar surrounds the inner collar of the lower frame, and (iii) the mounting flange of the intermediate frame is supported in close proximity to the perimeter flange therebelow, whereby a perimeter of the fabric panel about the ventilation opening is arranged to be secured between the perimeter flange of the lower frame below the fabric panel and the mounting flange of the intermediate frame above the fabric panel;

a cover joined to the lower frame so as to span over the frame opening of the lower frame, the cover comprising a lower portion arranged for connection to the outer collar of the intermediate frame and an upper portion above the lower portion, in which the upper portion has a diameter which protrudes radially outward beyond the inner collar of the lower frame about a full perimeter of the inner collar, the upper portion of the cover defining at least one exterior opening arranged to be in communication with the frame opening of the lower frame so as to prevent precipitation entering the frame opening of the lower frame while providing exterior ventilation from the ventilation opening of the building to said at least one exterior opening;

the lower portion of the cover being arranged to overlap an exterior surface portion of the outer collar of the intermediate frame below the upper portion of the cover and being arranged to be secured to the outer collar of the intermediate frame by a set of radial fasteners penetrated through the lower portion of the cover and the outer collar of the intermediate frame at a location below the upper portion of the cover.

2. The device according to claim 1 wherein the perimeter flange is arranged to be mechanically coupled to the fabric panel about a full perimeter of the ventilation opening in the fabric panel.

3. The device according to claim 1 wherein the intermediate frame is secured to the lower frame using threaded fasteners extending through cooperating apertures in the intermediate frame and the lower frame respectively.

4. The device according to claim 3 wherein the threaded fasteners are oriented to extend in an axial direction of the lower frame at circumferentially spaced apart locations between the inner collar and the outer collar.

5. The device according to claim 3 wherein the intermediate frame further comprises an upper flange protruding inwardly from the outer collar at a location spaced above the mounting flange of the intermediate frame, the threaded fasteners being coupled between the upper flange of the intermediate frame and the perimeter flange of the lower frame.

6. The device according to claim 1 wherein said at least one exterior opening is offset in a radial direction of the lower frame relative to the frame opening of the lower frame.

7. The device according to claim 1 wherein the cover protrudes radially outward beyond the inner collar of the lower frame about a full perimeter of the inner collar.

8. The device according to claim 7 wherein the cover includes a central cover portion which is devoid of openings and which fully spans over the frame opening of the lower frame.

9. The device according to claim 1 wherein said at least one exterior opening lies in an upright plane.

10. The device according to claim 1 wherein said at least one exterior opening faces downwardly towards the lower frame.

11. The device according to claim 1 wherein the cover is supported for rotation relative to the lower frame about an upright axis of the frame opening of the lower frame.

12. The device according to claim 1 wherein the lower portion of the cover comprises a lower collar having a diameter which is greater than a diameter of the outer collar of the intermediate frame.

13. The device according to claim 12 wherein the lower portion of the cover comprises a lower collar arranged to overlap the exterior surface portion of the outer collar of the intermediate frame across a full height of the outer collar of the intermediate frame.

14. A ventilation device for a building including a fabric panel supported under tension across a building frame of the building and a ventilation opening in the fabric panel, the ventilation device comprising:

a lower frame formed of rigid material having a perimeter flange surrounding a frame opening in the lower frame and an inner collar extending upwardly from an inner edge of the perimeter flange about the frame opening;

an intermediate frame including a mounting flange surrounding a frame opening in the intermediate frame, an outer collar extending upwardly from an inner edge of the mounting flange and an upper flange protruding inwardly from a top end of the outer collar, the intermediate frame being arranged to be coupled to the lower frame such that (i) the frame opening of the intermediate frame is aligned with the frame opening of the lower frame, (ii) the outer collar surrounds the inner collar of the lower frame, and (iii) the mounting flange of the intermediate frame is supported in close proximity to the perimeter flange therebelow, whereby a perimeter of the fabric panel about the ventilation opening is arranged to be secured between the perimeter flange of the lower frame below the fabric panel and the mounting flange of the intermediate frame above the fabric panel;

a cover joined to the lower frame so as to span over the frame opening of the lower frame, the cover defining at least one exterior opening arranged to be in communication with the frame opening of the lower frame so as to prevent precipitation entering the frame opening of the lower frame while providing exterior ventilation from the ventilation opening of the building to said at least one exterior opening;

the intermediate frame being secured to the lower frame using threaded fasteners extending axially through cooperating apertures in the perimeter flange of the lower frame and the upper flange of the intermediate frame;

the inner collar of the lower frame comprising a plurality of wall segments connected end-to-end with one another in a circumferential direction of the inner collar, each wall segment being convex in the circumferential direction at an interior of the inner collar and being concave in the circumferential direction at an exterior of the inner collar; and the outer collar of the intermediate frame surrounding the inner collar of the lower frame such that a pocket is formed between each wall segment and a respective portion of the outer collar to receive a respective one of the threaded fasteners extending axially therethrough.

15. The device according to claim 14 wherein an inner edge of the upper flange of the intermediate frame defines a convex segment in alignment with the convex interior of each wall segment of the inner collar of the lower frame.

* * * * *